US005836803A

United States Patent [19]

Hamlin

[11] Patent Number: 5,836,803

[45] Date of Patent: Nov. 17, 1998

[54] FIGURINE WITH MOVABLE LIMB

[75] Inventor: John Hamlin, Redondo Beach, Calif.

[73] Assignee: Namkung Promotions Inc., Costa Mesa, Calif.

[21] Appl. No.: 881,704

[22] Filed: Jun. 24, 1997

[51] Int. Cl.[6] ..... A63H 3/46; A63H 13/02; A63H 7/02

[52] U.S. Cl. ..... 446/379; 446/317; 446/333

[58] Field of Search ..... 446/317, 333, 446/334, 336, 379, 380, 376

[56] References Cited

U.S. PATENT DOCUMENTS

| | | | |
|---|---|---|---|
| 1,403,900 | 1/1922 | Evans | 446/317 |
| 2,249,670 | 7/1941 | Sidle | 446/333 |
| 2,560,657 | 7/1951 | Nogle | 446/379 |
| 3,700,384 | 10/1972 | Gardel et al. | 446/333 |
| 3,874,112 | 4/1975 | Sapkus et al. | 446/330 |
| 3,906,661 | 9/1975 | Weiser | 446/336 |
| 4,085,540 | 4/1978 | Jernstrom et al. | 446/333 |
| 4,932,919 | 6/1990 | Shapero | 446/374 |
| 5,087,219 | 2/1992 | Price | 446/336 |
| 5,580,295 | 12/1996 | Ruzskai et al. | 446/378 |

*Primary Examiner*—Robert A. Hafer

*Assistant Examiner*—Laura Fossum

*Attorney, Agent, or Firm*—Stetina Brunda Garred & Brucker

[57] ABSTRACT

A figurine replica of a person such as a player of a particular sport. The figurine replica has a front housing member replicating the front portion of a body of a person except for one limb member, a rear housing member secured to the front housing member and replicating the rear portion of the body of the person except for the limb member, and a replication of the limb member. The limb member has a spring component projecting therefrom and retained between the housing members such that the limb member can be moved by hand and the spring component returns the limb member to its original position. The spring and limb can be molded as a single unit, with the spring either in an elongate configuration for coiling upon assembly of the figurine replica or in an already-coiled configuration. Each of the front housing, rear housing and limb members and spring component is of a size larger than a throat entry of a person to thereby prevent swallowing and choking by a child who may place the figurine replica in his or her mouth. While the limb member can be either an arm or a leg, in a preferred embodiment the limb member is a leg and the spring action of the leg is a kicking action such as that exhibited by a soccer player.

32 Claims, 3 Drawing Sheets

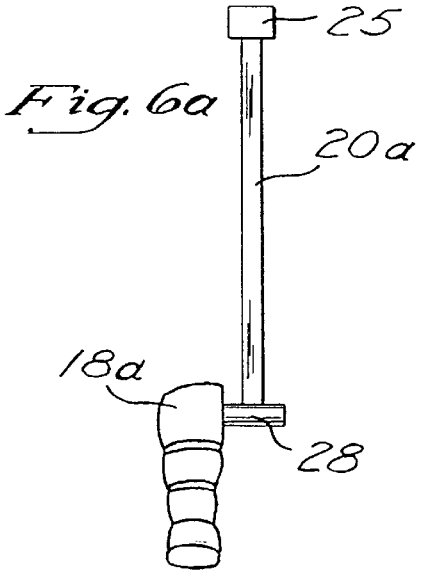
Fig. 6a
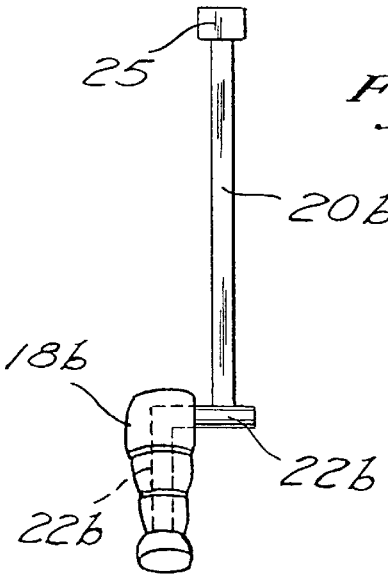
Fig. 6b
Fig. 6c
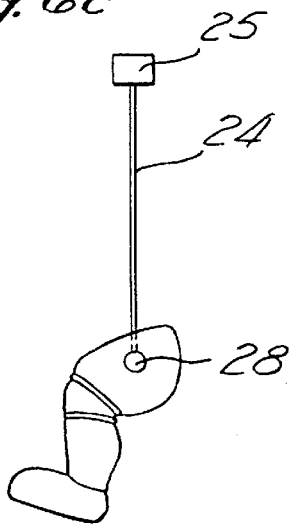
Fig. 6d
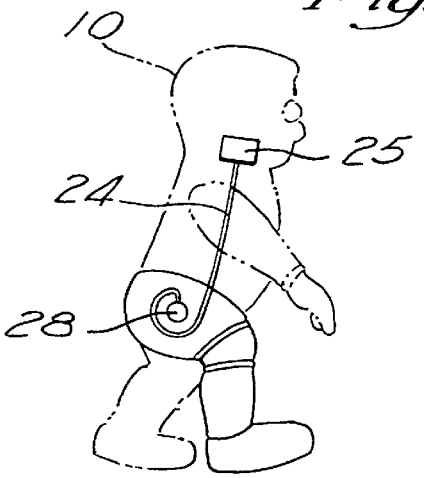

FIGURINE WITH MOVABLE LIMB

FIELD OF THE INVENTION

This invention relates in general to toys, and in particular to a figurine having a spring-loaded movable limb such as a kicking leg, with all constituents of the figurine being of a size larger than a throat entry of a person to thereby render the figurine child-safe.

BACKGROUND OF THE INVENTION

Because small toys are popular with children, it is common for such toys to not only be sold, but also to be included as promotional items that accompany fast-food meals, breakfast cereals, and other products appealable to children. A major concern of parents and health providers in relation to these toys is their size. Specifically, it is most important that a toy in both its assembled and disassembled state does not present a danger of choking if the toy itself or any part thereof is placed by a child in his or her mouth. Consequently, packaging of toys, games, puzzles, etc. having small parts that could be swallowed is marked to warn buyers of potential hazards and advising minimum ages for use. Because of this danger, small toys for smaller children generally are restricted to single-piece construction that has no moving or multiple parts so that a child cannot swallow and choke on any part of the toys.

In view of these size restrictions for toys for smaller children, action figures having built-in movement, such as figurines of sports participants, generally are not available for children under about three years of age. Because of this non-availability, not only are extended amusement and playtime with such toys not available, but also children are deprived of the opportunity of experiencing eye-hand coordination by manipulating movable-part toys. It is therefore apparent that a need is present for toys, and especially toy figurines, with movable parts that can be experienced by younger children. Accordingly, a primary object of the present invention is to provide a toy figurine having a spring-controlled movable limb wherein all of the components of the figurine are larger than a throat entry of a person.

Another object of the present invention is to provide a toy figurine wherein the movable limb is a leg that can be drawn rearwardly to thereafter provide a kicking action such as that made while playing soccer.

Yet another object of the present invention is to provide a toy figurine wherein the spring controlling limb action is integral with the limb to thereby assure component sizing that cannot be swallowed.

These and other objects of the present invention will become apparent throughout the description thereof which now follows.

SUMMARY OF THE INVENTION

The present invention is a figurine replica of a person such as a player of a particular sport. The figurine replica comprises a front housing member replicating the front portion of a body of a person except for one limb member, a rear housing member secured to the front housing member and replicating the rear portion of the body of the person except for the limb member, and a limb member comprising a replication of a limb of a person. The limb member has a spring component projecting therefrom and retained between the housing members such that the limb member can be moved by hand and the spring component returns the limb member to its original position. Each of the front housing member, rear housing member, limb member, and spring component, as well as an optional one-piece limb member and spring component unit, is of a size larger than a throat entry of a person to thereby prevent swallowing and choking by a child who may place the figurine replica in his or her mouth.

While the limb member can be either an arm member or a leg member, in a preferred embodiment the limb member is a leg member and the spring action of the leg member is a kicking action such as that exhibited by a soccer player. To accomplish this movement, the spring component comprises an anchor portion secured within the leg member, a coilable leaf portion disposed within a cavity formed between the front and rear housing members, and a bearing pin disposed between the anchor and leaf portions for pivotal movement of the leg member. The limb member and spring member can be of one piece construction of one material, and can be fabricated from a single moldable material such as a plastic material having adequate resilience such that the spring portion of the construction can store and deliver sufficient kinetic energy to thereby function as a spring. Likewise, the limb member can be constructed of one piece construction of two different moldable materials such as plastic materials that can be insert molded together. operability of the leg member allows a child to manipulate the toy such that it kicks a small item such as a raisin or the like in the same manner as a soccer player would kick a ball. The construction thus permits relatively small children to enjoy an action toy without causing undue worry for parents or guardians because of safety issues due to size of the toy or its constituent parts.

BRIEF DESCRIPTION OF THE DRAWINGS

An illustrative and presently preferred embodiment of the invention is shown in the accompanying drawings in which:

FIG. 6*a* is a front elevation view of a leg member and spring component unit of one-piece construction of one moldable material with a non-coiled spring component;

FIG. 6*b* is a front elevation view of a leg member and spring component unit of one-piece construction of two moldable materials insert molded together and with a non-coiled spring component;

FIG. 6*c* is a side elevation view of the leg member and spring component unit of either FIGS. 6*a* or 6*b;*

FIG. 6*d* is a side elevation view of the leg member and spring component unit of either FIGS. 6*a* or 6*b* with the spring component thereof in coiled configuration;

DETAILED DESCRIPTION OF THE PREFERRED EMBODIMENT

Figure 1:
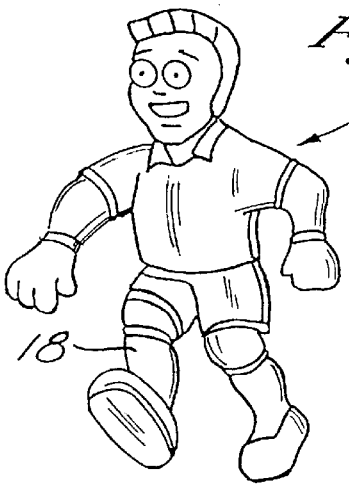
FIG. 1 is a perspective view of a toy figurine having a pivoting leg member.
Figure 2:
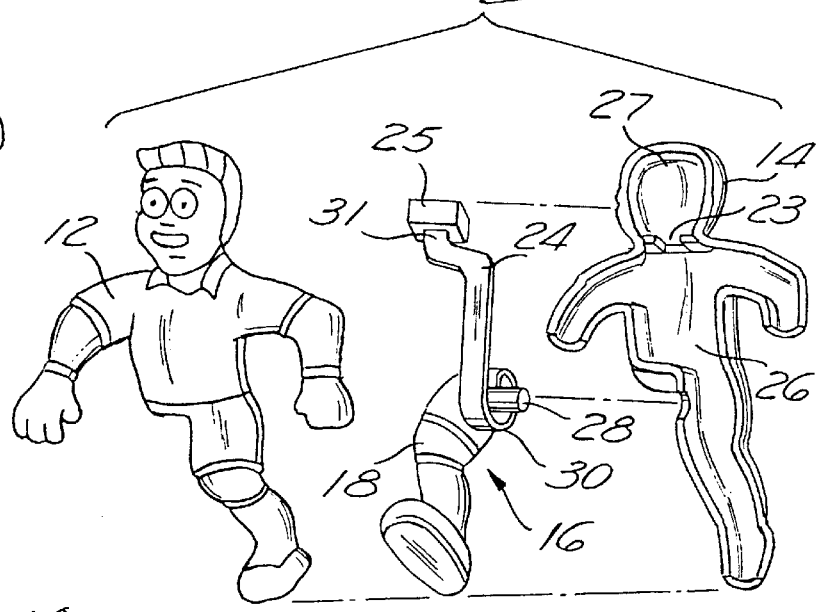
FIG. 2 is an exploded view of the figurine of FIG. 1 showing the parts thereof.
Figure 5:
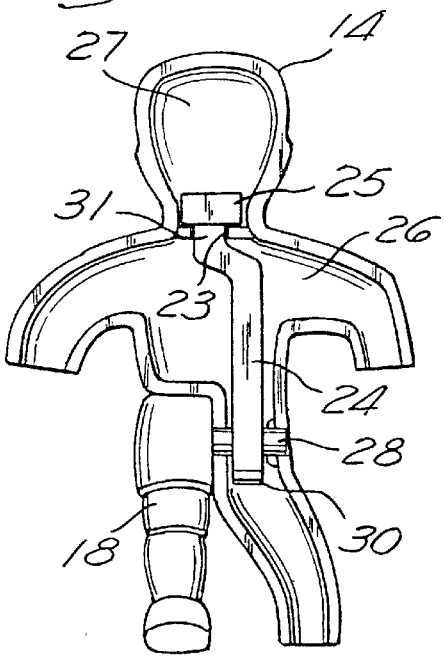
FIG. 5 is a front elevation view of the leg member and spring component unit in position in relation to a rear housing member of the toy.
Figure 3:
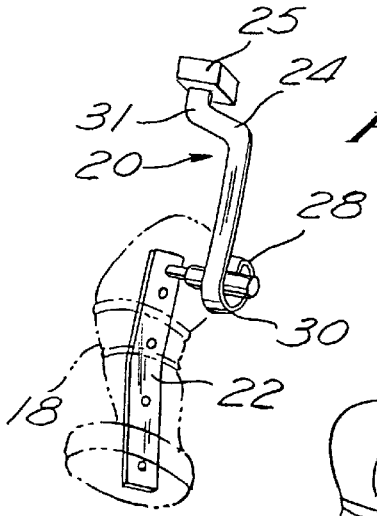
FIG. 3 is a perspective view of a spring component providing leg member movement to the toy.

Referring to FIGS. 1–5, a toy figurine 10 is shown. The figurine 10 is a replica of a person, and is constructed of a front housing member 12, a rear housing member 14, and an integral leg-and-spring unit 16 that can be of one-piece construction as here shown. The unit 16 includes a replica of a leg member 18 and a coiled spring component 20, with the spring component 20 having an anchor portion 22 secured within the leg member 18 and a leaf portion 24 within a cavity 26 formed between the front housing member 12 and rear housing member 14. The top of the leaf portion 24 is configured as a cube 25 that resides within the head portion 27 of the cavity 26 and is there retained as the portion 31 of the spring component 20 immediately below the cube 25 fits within a notch retainer 23 of the rear housing member 14. A rib (not shown) complimentarily disposed within the front housing member 12 to abut the notch 23 maintains the portion 31 of the spring component 20 within the notch 23 when the figurine is in assembled form. A bearing pin 28 is disposed between the anchor portion 22 and leaf portion 24 for pivotal movement of one portion 22 or 24 relative to the other such that the leg member 18 can be pivotally moved in a single plane from front to back when the end of the bearing pin 28 is retained as within a boss as shown in FIG. 5. The base of the leaf portion 24 has a coil 30.

Figure 7A:
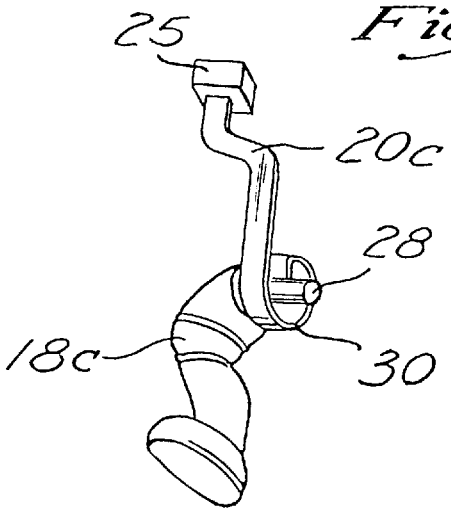
FIG. 7*a* is a perspective view of a leg member and spring component unit of one-piece construction of one moldable material with a coiled spring component.
Figure 7B:
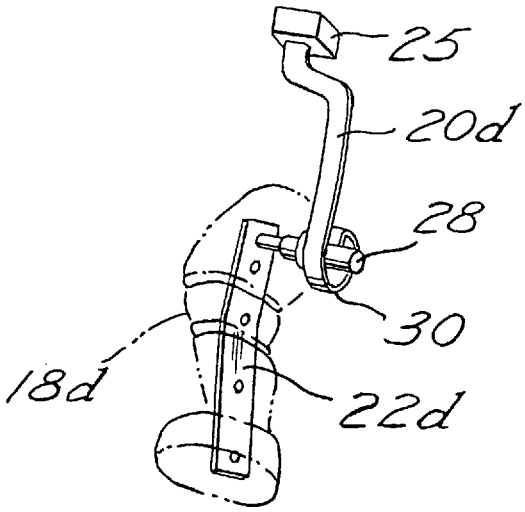
FIG. 7*b* is a front elevation view of a leg member and spring component unit of one-piece construction of two moldable materials insert molded together and with a coiled spring component.

Although the leg member 18 and spring component 20 can be separate pieces, the leg-and-spring unit 16 also can be constructed as one piece, as specifically illustrated in FIGS. 6*a*–6*d*. In particular, referring to FIG. 6*a*, the leg member 18*a* and spring component 20*a* can be constructed of a one-piece, moldable, resilient, thermoplastic material such as nylon or acetal or the like. Conversely, referring to FIG. 6*b*, the leg member 18*b* and spring component 20*b* can be constructed in one piece, but of two different moldable materials insert molded together such that the anchor portion 22*b* of the spring component 20*b* is insert molded within the leg member 18*b*. With such insert molding, only the spring component 20*b* needs to be a resilient thermoplastic material such as, once again, nylon or acetal or the like. As shown in FIG. 6*c*, the leaf portion 24 initially is straight, and is coiled at its base, as shown in FIG. 6*d*, by hand when the toy 10 is assembled. Instead of manufacturing the spring component in a non-coiled configuration for subsequent coiling by hand, the leg-and-spring unit 16 can not only be constructed as one piece, but the spring component can be molded in a coiled configuration as shown in FIG. 7*a* where leg member 18c and spring component 20*c* are one piece and the spring component 20*c* is provided with a molded coil 30. Likewise, as shown in FIG. 7*b*, the leg member 18d can be constructed in one piece, but of two different moldable materials insert molded together such that the anchor portion 22*d* of the spring component 20*d* is insert molded within the leg member 18*d* and such that a molded coil 30 is provided. In all embodiments, the front housing member, rear housing member, leg and spring member are each individually of a size that is larger than a throat entry of a person. However, the figurine 10 itself is small enough to be easily held and manipulated by a child of about one year of age. All of the parts of the figurine 10 can be constructed of a plastic material.

Figure 4:
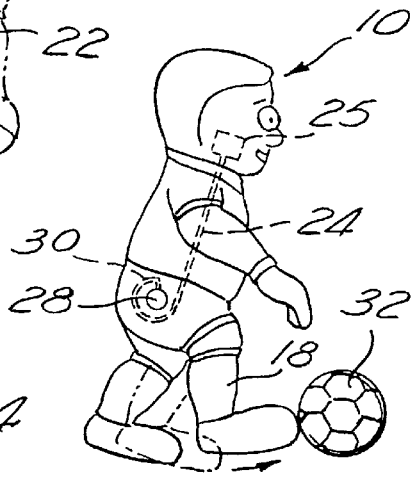
FIG. 4 is a side elevation view of the toy figurine of FIG. 1 showing kicking action of the leg member.

In operation, a child can pull rearwardly on the movable leg member 18 as shown in phantom lines in FIG. 4 which coils the spring member 20 such that kinetic energy is stored therein. The leg member 18 then can be placed in alignment with an item (here a miniature soccer ball 32) to be kicked, and then released to cause the spring member 20 to release stored kinetic energy and force the leg member 18 forward and propel the item to be kicked. Such activity can be repeated as often as the child desires, and aids in eye-hand coordination development while providing amusement. Simultaneously, if the child should place the figurine 10 in his or her mouth, it cannot be swallowed. By providing the cube 25 at the top of the leaf portion 24 of the spring component 20 and retaining the cube 25 via cooperation of the notch 23 as earlier described, at least two additional goals are accomplished. First, such retention makes it considerably difficult for a child to extract the spring component 20 and associated leg member 18. If successful disassembly is accomplished by vigorous pulling on the leg member 20, the spring component 20 will become stretched and thus enlarged and grossly not swallowable. Second, if disassembly occurs, a cube configuration combined with an attached spring component will not be conducive to a swallowing action. Likewise, if the figurine 10 should break or otherwise become disassembled, no part of it can fit within the throat entry of the child and the fear of choking is therefore alleviated.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A figurine replica of a person comprising:

a) a front housing member replicating without moving parts the front portion of a body of a person except for one limb member;

b) a rear housing member secured to the front housing member and replicating without moving parts the rear portion of the body of the person of (a) above except for said limb member;

c) a movable limb member comprising a replication of a limb of a person and having a spring component projecting therefrom and retained between the housing members such that the limb member can be moved solely by hand contact therewith and the spring component returns the limb to its original position, with said front housing member, rear housing member, limb member, and spring component each of a size larger than a throat entry of a person.

2. A figurine replica as claimed in claim 1 wherein the front and rear housing members form a cavity therebetween and wherein a portion of the spring component is retained.

3. A figurine replica as claimed in claim 2 wherein the limb member is a replication of a leg.

4. A figurine replica as claimed in claim 3 wherein the spring component comprises an anchor portion secured within the limb member, a coilable leaf portion disposed within the cavity, and a bearing pin disposed between the anchor and leaf portions for pivotal movement of one portion relative to the other portion.

5. A figurine replica as claimed in claim 4 wherein the replication of the limb member and the spring component are of one piece construction of one material.

6. A figurine replica as claimed in claim 5 wherein the replication of the limb member and the spring component are constructed of a plastic.

7. A figurine replica as claimed in claim 4 wherein the replication of the limb member and the spring component are of one piece construction of two different moldable materials insert molded together.

8. A figurine replica as claimed in claim 7 wherein the two moldable materials are plastic materials.

9. A figurine replica as claimed in claim 4 wherein the limb member can be moved to a kicking configuration.

10. A figurine replica as claimed in claim 1 wherein the limb member is a replication of a leg.

11. A figurine replica as claimed in claim 10 wherein the limb member can be moved to a kicking configuration.

12. A figurine replica as claimed in claim 1 wherein the spring component comprises an anchor portion secured within the limb member, a coilable leaf portion disposed between the housing members, and a bearing pin disposed between the anchor and leaf portions for pivotal movement of one portion relative to the other portion.

13. A figurine replica as claimed in claim 12 wherein the coilable leaf portion has a top cube-shaped portion secured by a retainer disposed within the cavity.

14. A figurine replica as claimed in claim 1 wherein the replication of the limb member and the spring component are of one piece construction of one material.

15. A figurine replica as claimed in claim 14 wherein the spring component is molded in a coiled configuration.

16. A figurine replica as claimed in claim 14 wherein the replication of the limb member and the spring component are constructed of a plastic.

17. A figurine replica as claimed in claim 1 wherein the replication of the limb member and the spring component are of one piece construction of two different moldable materials insert molded together.

18. A figurine replica as claimed in claim 17 wherein the spring component is molded in a coiled configuration.

19. A figurine replica as claimed in claim 17 wherein he two moldable materials are plastic materials.

20. A figurine replica of a person comprising:

a) a front housing member replicating without moving parts the front portion of a body of a person except for one leg member;

b) a rear housing member secured to the front housing member and replicating without moving parts the rear portion of the body of the person of (a) above except for said leg member;

c) a leg member comprising a replication of a leg of a person and having a spring component projecting therefrom and retained between the housing members such that the leg member can be moved solely by hand contact therewith and the spring component returns the leg to its original position, with said front housing member, rear housing member, leg member, and spring component each of a size larger than a throat entry of a person.

21. A figurine replica as claimed in claim 20 wherein the spring component comprises an anchor portion secured within the leg, a coilable leaf portion disposed within a cavity formed between the front and rear housing members, and a bearing pin disposed between the anchor and leaf portions for pivotal movement of the leg.

22. A figurine replica as claimed in claim 21 wherein the coilable leaf portion has a top cube-shaped portion secured by a retained disposed within the cavity.

23. A figurine replica as claimed in claim 21 wherein the leg member and the spring component are of one piece construction of one material.

24. A figurine replica as claimed in claim 23 wherein the leg and the spring component are constructed of a plastic.

25. A figurine replica as claimed in claim 21 wherein the replication of the limb member and the spring component are of one piece construction of two different moldable materials insert molded together.

26. A figurine replica as claimed in claim 25 wherein the two moldable materials are plastic materials.

27. A figurine replica as claimed in claim 20 wherein the leg member and the spring component are of one piece construction of one material.

28. A figurine replica as claimed in claim 27 wherein the spring component is molded in a coiled configuration.

29. A figurine replica as claimed in claim 23 wherein the leg and the spring component are constructed of a plastic.

30. A figurine replica as claimed in claim 20 wherein the replication of the limb member and the spring component are of one piece construction of two different moldable materials insert molded together.

31. A figurine replica as claimed in claim 30 wherein the spring component is molded in a coiled configuration.

32. A figurine replica as claimed in claim 30 wherein the two moldable materials are plastic materials.

* * * * *